US006523946B2

(12) United States Patent
Mou et al.

(10) Patent No.: US 6,523,946 B2
(45) Date of Patent: Feb. 25, 2003

(54) INK-JET CARTRIDGE

(75) Inventors: Tse-Chi Mou, Hsin Chu (TW); Fu-San Lin, Hsin Chu (TW); Chin-Yi Chou, Hsin Chu (TW); Jing-Yuan Ho, Hsin Chu (TW); Yi-Jing Leu, Hsin Chu (TW); Li-Hsing Peng, Hsin Chu (TW); Ta-Wei Hsueh, Hsin Chu (TW)

(73) Assignee: Microjet Technology Company, Ltd. (TW)

( * ) Notice: Subject to any disclaimer, the term of this patent is extended or adjusted under 35 U.S.C. 154(b) by 0 days.

(21) Appl. No.: 09/851,824

(22) Filed: May 9, 2001

(65) Prior Publication Data

US 2001/0028379 A1 Oct. 11, 2001

Related U.S. Application Data

(63) Continuation-in-part of application No. 09/433,225, filed on Nov. 4, 1999, now abandoned.

(51) Int. Cl.[7] ..... B41J 2/175
(52) U.S. Cl. ..... 347/86; 347/87
(58) Field of Search ..... 347/84, 85, 86, 347/87; 101/125

(56) References Cited

U.S. PATENT DOCUMENTS 3,661,078 A * 5/1972 Hammel ..... 101/125
4,412,232 A 10/1983 Weber et al. ..... 347/68
5,409,134 A 4/1995 Cowger et al. ..... 222/1
5,600,358 A 2/1997 Baldwin et al. ..... 347/87
5,801,737 A 9/1998 Sato et al. ..... 347/86
5,988,803 A * 11/1999 Komplin et al. ..... 347/86

* cited by examiner

*Primary Examiner*—Anh T. N. Vo
(74) *Attorney, Agent, or Firm*—Michael Best & Friedrich, LLC

(57) ABSTRACT

An ink-jet cartridge adapted to be used for a thermal ink-jet printer is disclosed. The ink-jet cartridge includes a housing for storing the ink in an interior thereof, a printhead having a plurality of orifices thereon for allowing the ink to be Jetted therethrough when the thermal ink-jet printer is printing, and a pressure-adjusting device disposed in the housing for regulating a back pressure of the interior of the housing, wherein the pressure-adjusting device includes a first opening fixed on an upper portion of the housing and exposed to an ambient atmosphere, and a second opening disposed at a bottom of the interior of the housing and having at least one regulating hole thereon. Each regulating hole has a cross-sectional area being smaller than that of the first opening for maintaining the back pressure when the ink-jet cartridge is inverted.

11 Claims, 6 Drawing Sheets

INK-JET CARTRIDGE

The present invention is a continuation-in-part application of the parent application bearing Ser. No. 09/433,225 and filed on Nov. 4, 1999 now abandoned.

FIELD OF THE INVENTION

The present invention relates to an ink-jet cartridge for being used for a thermal ink-jet printer, and more particularly to an ink-jet cartridge containing a back pressure-adjusting device therein for being used for a thermal ink-jet printer.

BACKGROUND OF THE INVENTION

Currently, three kinds of printers, i.e. dot-matrix printer, thermal ink-jet printer and laser printer, are commercially available for adapting to be used for a computer. In spite of that a dot-matrix printer has an advantage of the lowest price among them, which has the disadvantages of the slowest printing speed and the most inferior printing quality among them. Although a laser printer has an advantage of the best printing quality among them, which, particularly for a color laser printer, has the disadvantage of the highest price among them. Therefore, up to the present, the thermal ink-jet printer is the most popular one for the general public.

Please refer to FIG. 1 which is a schematic diagram illustrating a structure of a conventional ink-jet cartridge 10 adapted to be used for a thermal ink-jet printer. Conventionally, an ink-jet cartridge 10 includes a housing 11 for storing the ink 13 in an interior 12 thereof, and a printhead 14 having a plurality of orifices (not shown) thereon for allowing the ink 13 to be jetted therethrough when the thermal ink-jet printer is printing. According to the ideal-gas law, $$PV=nRT$$

where P: pressure, V: volume, n: mole number of the gas molecules, R: ideal-gas constant, T: temperature if the temperature is maintained at a constant value, the pressure would inversely change with the volume. Certainly, when the thermal ink-jet printer is printing under the environmental temperature, the volume of the space 121 unfilled with the ink 13 will gradually increase because of consumption of the ink 13. That is, if the volume of the space 121 unfilled with the ink 13 increases when the thermal ink-jet printer is printing, a back pressure of the space 121 would lower simultaneously. On the other hand, if the environmental changes, the back pressure of the space 121 might change as well. Once the back pressure changes, it might be so easy or so hard for the ink 13 to be jetted through the orifices and therefore the printing quality is influenced.

Please refer to FIG. 2(*a*) which is a schematic diagram illustrating another structure of a conventional ink-jet cartridge 20 adapted to be used for a thermal ink-jet printer. Comparing the ink-jet cartridge 20 of FIG. 2(*a*) with that of FIG. 1, in addition to a housing 21 for storing the ink 23 in an interior 22 thereof and a printhead 24 having a plurality of orifices (not shown) thereon for allowing the ink 23 to be jetted therethrough when the thermal ink-jet printer is printing, the ink-jet cartridge 20 further includes a hollow tube 25. Preferably, a diameter of the hollow tube 22 is ranged from 0.5 to 2.0 mm. The hollow tube 22 is used for regulating the back pressure of the space 221 by a capillary action of the ink 231 contained in the hollow tube 25. Even if the volume of the space 221 increases when the thermal ink-jet printer is printing, the back pressure of the space 221 would not lower. However, as shown in FIG. 2(*b*), when the ink-jet cartridge 20 is inverted unwarily during transportation, owing to the low value of the surface tension of the ink 231 contained in the hollow tube 25, it is easy for the ink 231 to flow out of the hollow tube 25 or the atmosphere 26 might pass into the hollow tube 25 such that the back pressure of the space 221 unfilled with the ink 231 will not be controlled at a desired suitable range any more. Although a much thinner hollow tube, which provides a higher value of the surface tension of the ink 231 contained in the hollow tube 25, can be provided to solve the problem, the yield for manufacturing such a much thinner hollow tube is so low that the manufacturing cost thereof is very high.

Accordingly, it is attempted by the present applicant to overcome the above-described problems encountered in the prior arts.

SUMMARY OF THE INVENTION

An object of the present invention is to provide an ink-jet cartridge containing a back pressure-adjusting device therein for being used for a thermal ink-jet printer.

Another object of the present invention is to provide an easily-manufactured back pressure-adjusting device of an ink-jet cartridge for being used for a thermal ink-jet printer.

According to the present invention, the ink-jet cartridge adapted to be used for a thermal ink-jet printer is disclosed. The ink-jet cartridge includes a housing for storing the ink in an interior thereof, a printhead having a plurality of orifices thereon for allowing the ink to be jetted therethrough when the thermal ink-jet printer is printing, and a pressure-adjusting device disposed in the housing for regulating a back pressure of the interior of the housing, wherein the pressure-adjusting device includes a first opening fixed on an upper portion of the housing and exposed to an ambient atmosphere, and a second opening disposed at a bottom of the interior of the housing and having at least one regulating hole thereon, wherein the regulating hole has a cross-sectional area being smaller than that of the first opening for maintaining the back pressure when the ink-jet cartridge is inverted.

Preferably, the back pressure of the interior of the housing is regulated by a capillary action of the ink contained in the pressure-adjusting device.

Preferably, the second opening of the pressure-adjusting device is fixed at the bottom of the interior of the housing.

Preferably, the second opening of the pressure-adjusting device is hung over the bottom of the interior of the housing.

Preferably, the pressure-adjusting device is a hollow tube.

Preferably, a diameter of the hollow tube is identical except a portion adjacent to the second opening.

Preferably, the diameter is ranged from 0.5 to 2.0 mm.

Preferably, the hollow tube is made of stainless.

Preferably, the second opening is pressed such that one regulating hole is formed thereon and the second opening is plane-shaped in cross-section.

Preferably, the second opening is pressed such that a plurality of regulating holes are formed thereon.

Preferably, the pressure-adjusting device is made of plastic.

Preferably, the pressure-adjusting device is formed by injection molding.

Preferably, the pressure-adjusting device is integrally formed with the housing by injection molding.

BRIEF DESCRIPTION OF THE DRAWINGS

The present invention may best be understood through the following description with reference to the accompanying drawings, in which:

FIG. 2(*b*) is a schematic diagram showing an inverted ink-jet cartridge of FIG. 2(*a*).

FIG. 4(*b*) is a schematic diagram illustrating a side view of a portion adjacent to the second opening of FIG. 4(*a*);

FIG. 5(*b*) is a schematic diagram illustrating a side view of a portion adjacent to the second opening of FIG. 5(*a*)

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention is related to an ink-jet cartridge adapted to be used for a thermal ink-jet cartridge. A back pressure-adjusting device, preferably a hollow tube, is disposed in a housing of the ink-jet cartridge. The back pressure can be maintained at a desired suitable range all the time even if the ink-jet cartridge is inverted unwarily during transportation.

Figure 1:
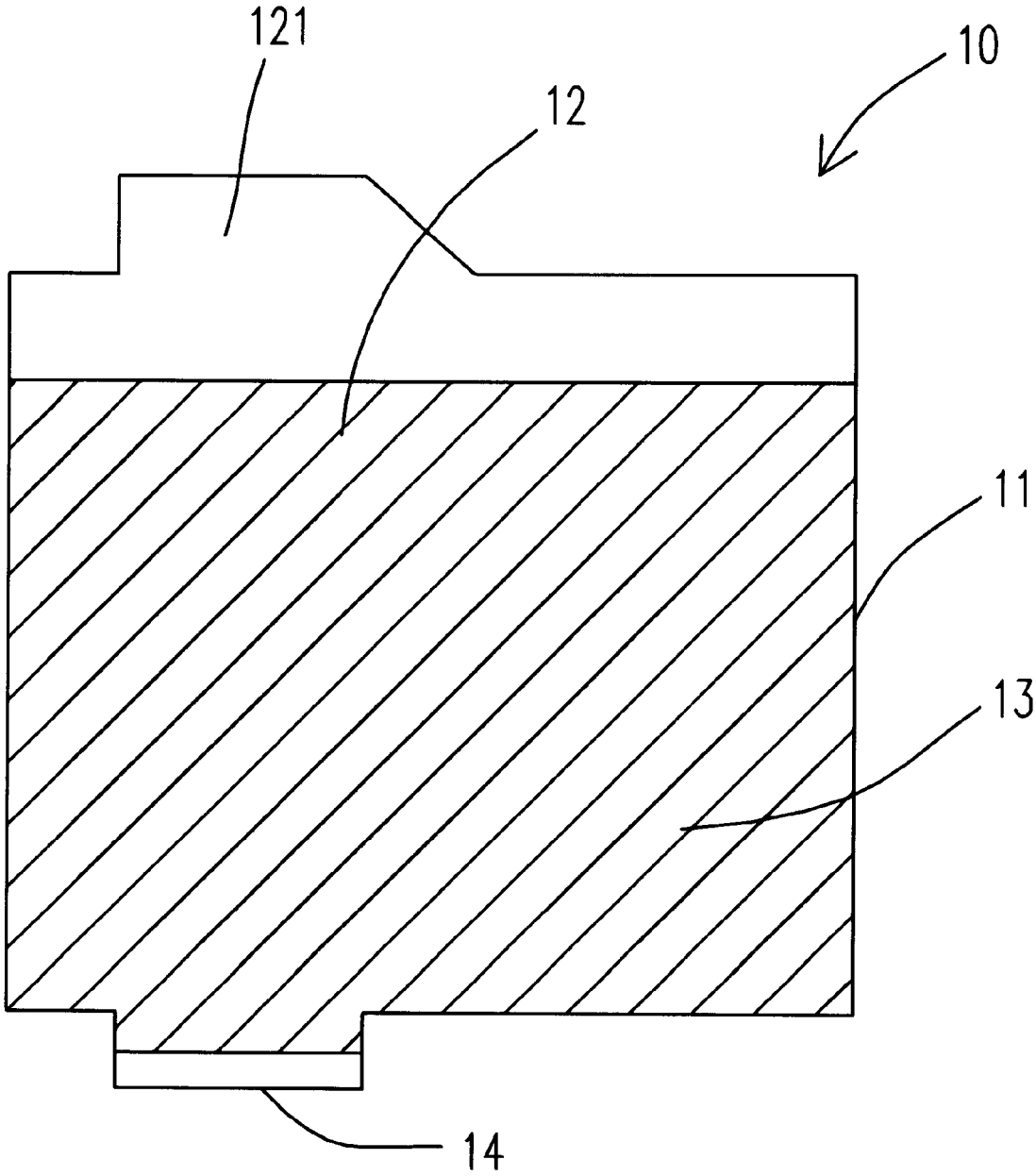
Fig. 1 (PRIOR ART)
FIG. 1 is a schematic diagram illustrating a structure of a conventional ink-jet cartridge adapted to be used for a thermal ink-jet printer.
Figure 2A:
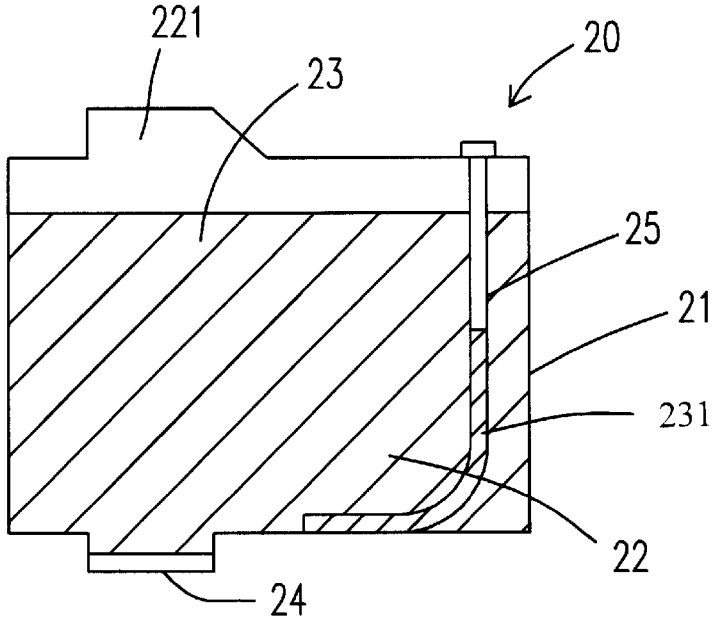
Fig. 2(a) (PRIOR ART)
FIG. 2(*a*) is a schematic diagram illustrating another structure of a conventional ink-jet cartridge adapted to be used for a thermal ink-jet printer.
Figure 2B:
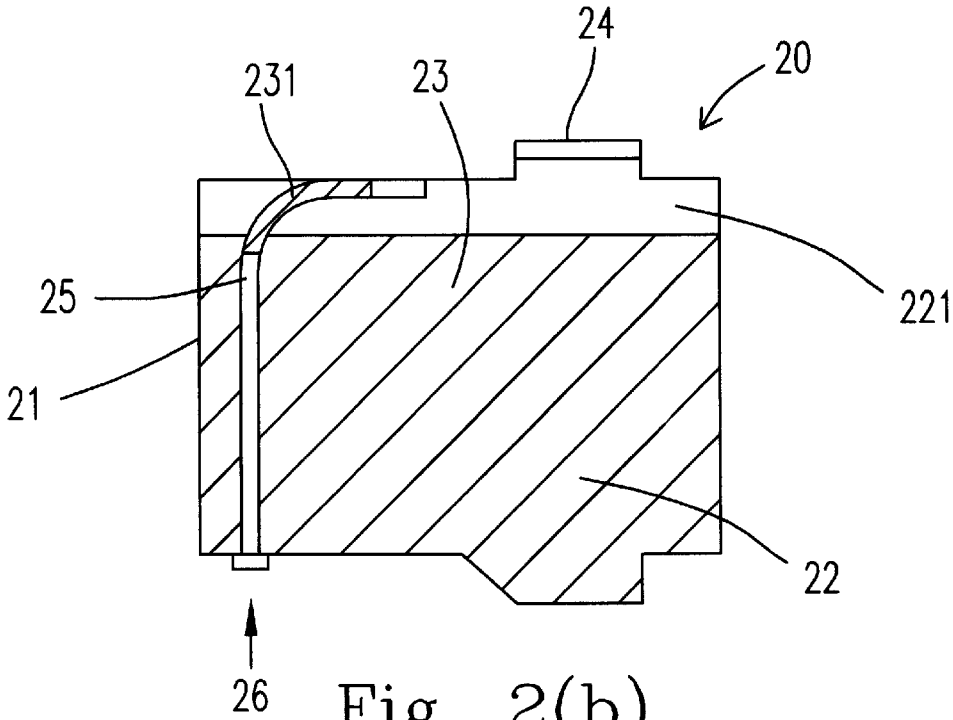
Fig. 2(b) (PRIOR ART)
Figure 3:
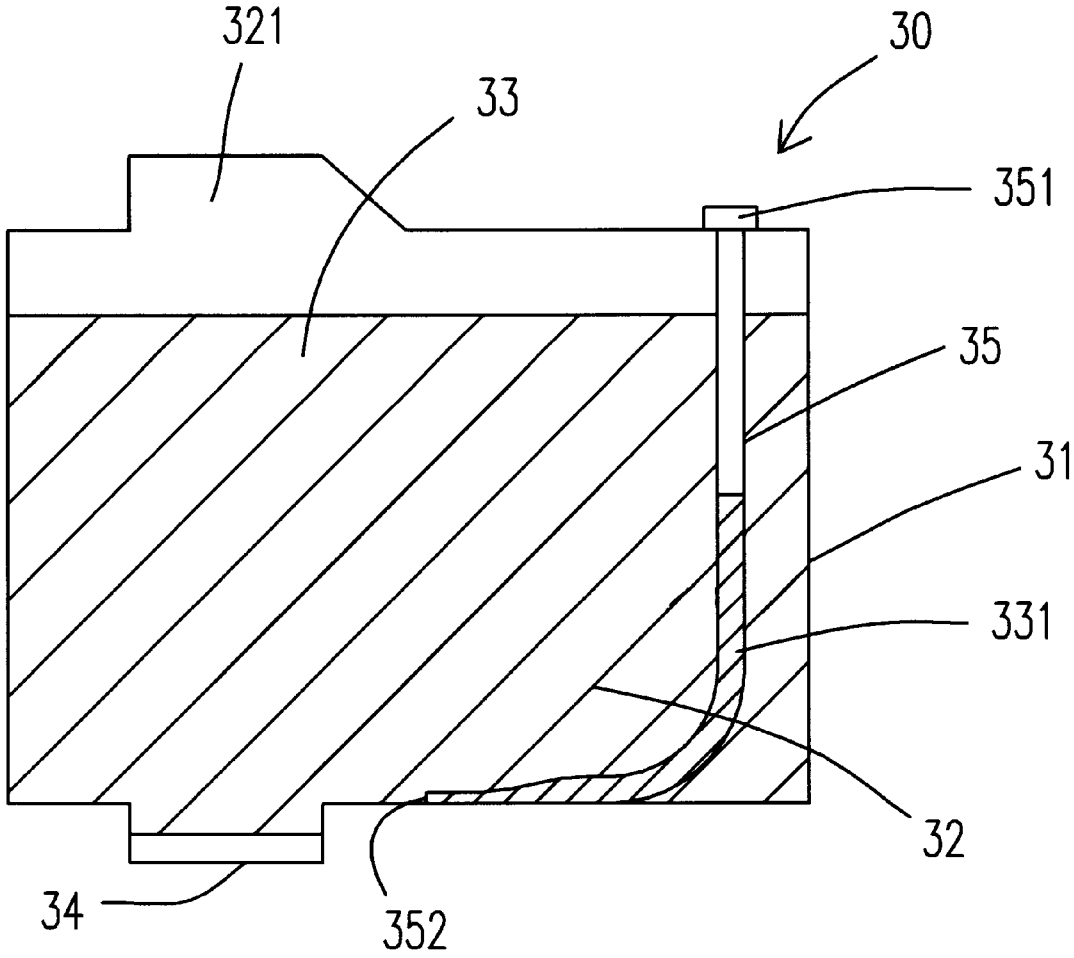
FIG. 3 is a schematic diagram illustrating a structure of an ink-jet cartridge adapted to be used for a thermal ink-jet printer according to the present invention.

Please refer to FIG. 3 which is a schematic diagram illustrating a structure of an ink-jet cartridge 30 adapted to be used for a thermal ink-jet printer according to the present invention. The ink-jet cartridge 30 includes a housing 31 for storing the ink 33 in an interior 32 thereof, a printhead 34 having a plurality of orifices (not shown) thereon for allowing the ink 33 to be jetted therethrough when the thermal ink-jet printer is printing, and a hollow tube 35 disposed in the housing 31 for regulating a back pressure of the interior 32 of the housing 31.

Figure 4A:
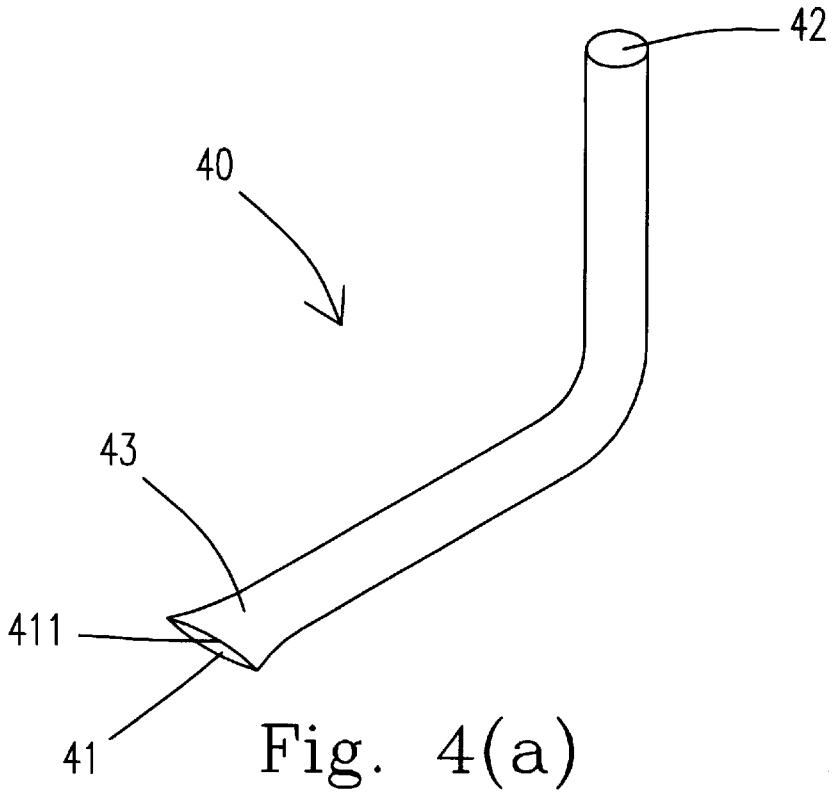
FIG. 4(*a*) is a schematic diagram illustrating a first preferred embodiment of a structure of a hollow tube according to the present invention.
Figure 4B:
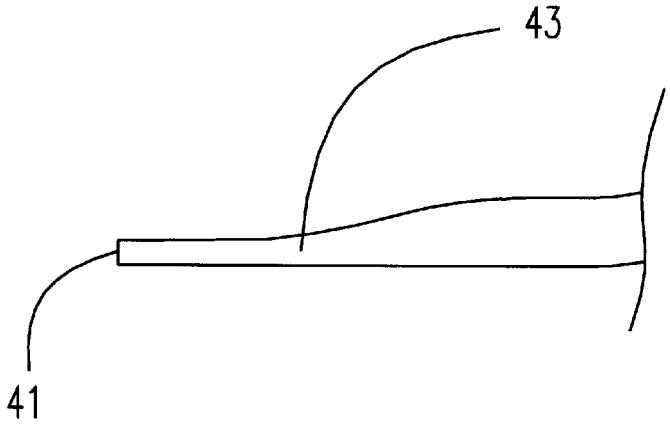

The hollow tube 35 includes a first opening 351 fixed on an upper portion of the housing 31 and exposed to an ambient atmosphere, and a second opening 352 disposed at a bottom of the interior 32 of the housing 31. Certainly, the second opening 352 could be fixed at or hung over the bottom of the interior 32 of the housing 31. The back pressure of the space 321 unfilled with the ink 33 is regulated by a capillary action of the ink 331 contained in the hollow tube 35. The second opening 352 has at least one regulating hole (as shown in FIGS. 4(*a*), 4(*b*), 5(*a*) and 5(*b*)) thereon, wherein each regulating hole has a cross-sectional area being smaller than that of the first opening 351. That is, except a portion adjacent to the second opening 352, a diameter of the hollow tube 35 is identical. Preferably, the diameter is ranged from 0.5 to 2.0 mm. The back pressure can be maintained at a desired suitable range all the time even if the ink-jet cartridge 30 is inverted unwarily during transportation.

Please refer to FIG. 4(*a*) which is a schematic diagram illustrating a first preferred embodiment of a structure of a hollow tube 40 according to the present invention. Preferably, the hollow tube 40 is made of stainless. The second opening 41 is pressed such that a regulating hole 411 is formed thereon and therefore the second opening 41 is plane-shaped in cross-section. The regulating hole 411 has a cross-sectional area being smaller than that of the first opening 42. A side view of a portion 43 adjacent to the second opening 41 is shown in FIG. 4(*b*). Certainly, if the hollow tube 40 is made of plastic or rubber, the hollow tube 40 could be formed by injection molding as well.

Figure 5A:
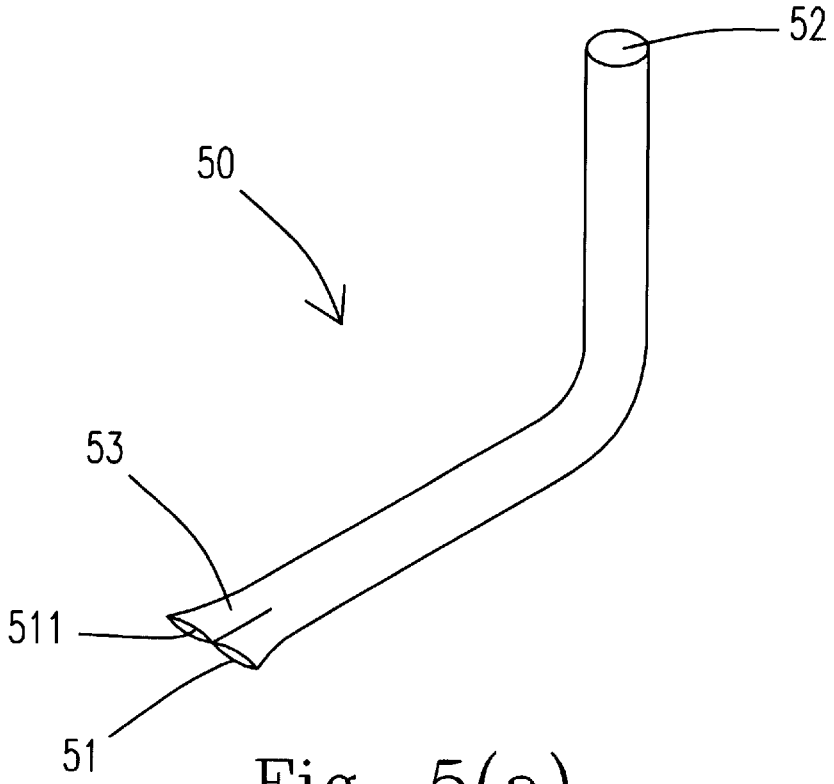
FIG. 5(*a*) is a schematic diagram illustrating a second preferred embodiment of a structure of a hollow tube according to the present invention.
Figure 5B:
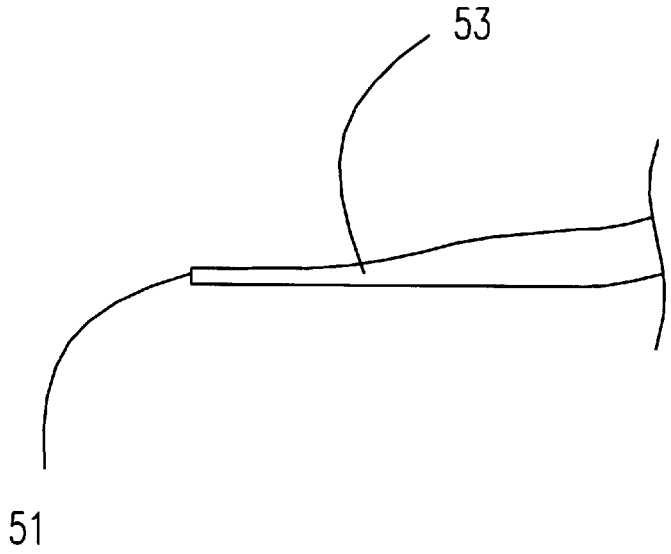

Please refer to FIG. 5(*a*) which is a schematic diagram illustrating a second preferred embodiment of a structure of a hollow tube 50 according to the present invention. Preferably, the hollow tube 50 is made of stainless. The second opening 51 is pressed such that a plurality of regulating holes 511 are formed thereon. Each regulating hole 511 has a cross-sectional area being smaller than that of the first opening 52. Preferably, each regulating hole has a cross-sectional area ranging from 0.05 to 2.5 $mm^2$. A side view of a portion 53 adjacent to the second opening 51 is shown in FIG. 5(*b*). Certainly, if the hollow tube 40 is made of plastic or rubber, the hollow tube 40 could be formed by injection molding as well.

Figure 6:
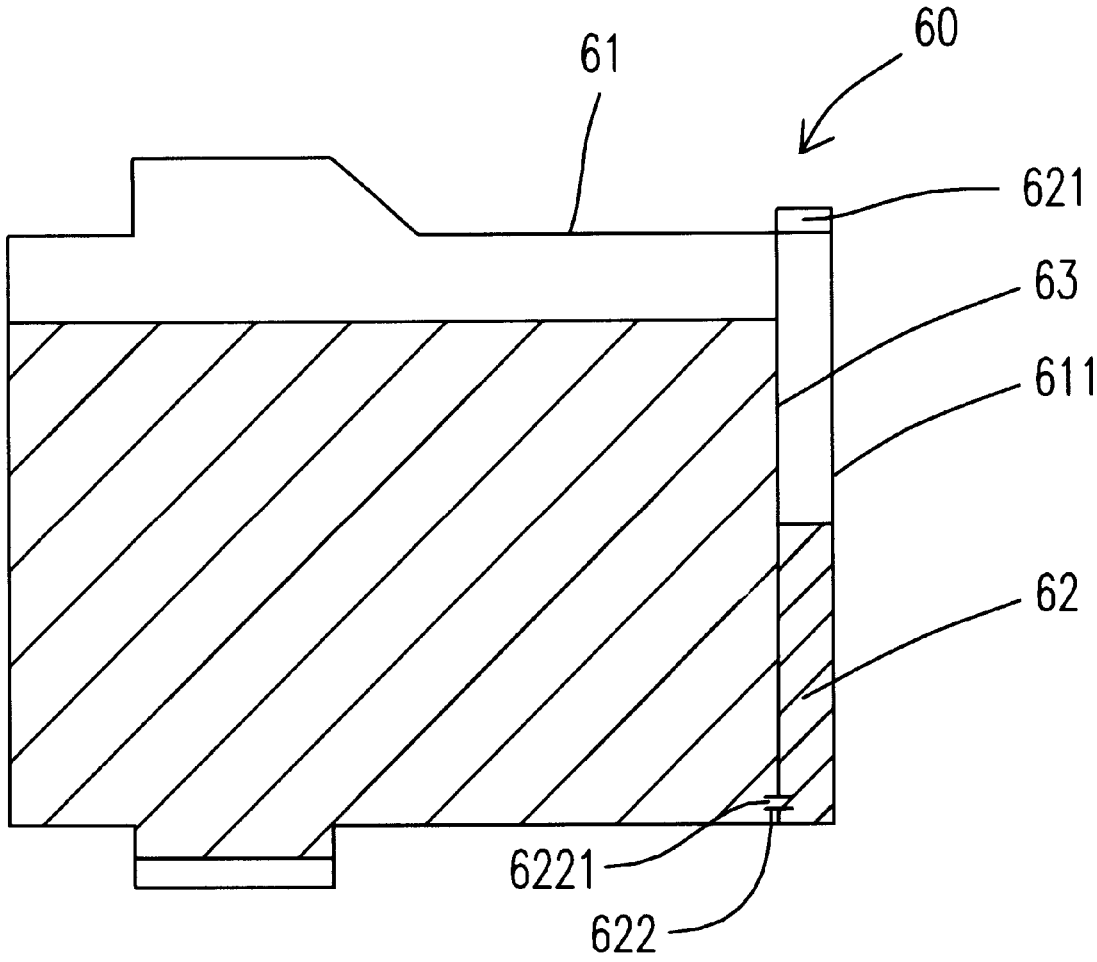
FIG. 6 is another embodiment of an ink-jet cartridge adapted to be used for a thermal ink-jet printer according to the present invention.

Please to FIG. 6 which is another embodiment of an ink-jet cartridge 60 adapted to be used for a thermal ink-jet printer according to the present invention. If the hollow tube 62 is made of plastic or rubber, the hollow tube 62 can be integrally formed with the housing 61 of the ink-jet cartridge 60 by injection molding. The regulating hole 6221 formed on the second opening 622 has a cross-sectional area being smaller than that of the first opening 621. Preferably, each regulating hole has a cross-sectional area ranging from 0.05 to 2.5 $mm^2$. Certainly, the hollow tube 62 can be alternatively replaced with a rectangular enclosure to perform the capillary action. That is, a plane wall 63 being parallel to a side wall 611 of the housing 61 is integrally formed with the housing 61 of the ink-jet cartridge 60 by injection molding.

According to the present invention, each regulating holes having a cross-sectional area being smaller than that of the first opening is formed for increase the surface tension of the ink contained in the hollow tube. If the ink-jet cartridge is inverted unwarily during transportation, it is not easy for the ink contained in the hollow tube to flow out of the hollow tube or for the atmosphere passing into the hollow tube. Therefore, the back pressure can be maintained at a desired suitable range all the time by the back pressure-adjusting device. In addition, the back pressure-adjusting device can be easily manufactured as well. The problems encountered in the prior arts are thus solved.

While the invention has been described in terms of what are presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An ink-jet cartridge adapted to be used for a thermal ink-jet printer, comprising:

a housing for storing ink in an interior thereof;

a printhead having a plurality of orifices thereon for allowing said ink to be jetted therethrough when said thermal ink-jet printer is printing; and a pressure-adjusting device disposed in said housing for regulating a back pressure in said interior of said housing;

wherein said pressure-adjusting device is a hollow tube comprising a first opening fixed on an upper portion of said housing and exposed to ambient atmosphere, and a second opening disposed at a bottom of said interior of said housing and having at least one regulating hole thereon;

wherein said hollow tube has an identical and uniform diameter except for a portion of said hollow tube adjacent to said second opening, said second opening is pressed such that a plurality of regulating holes are formed thereon and said regulating hole have a cross-sectional area smaller than a cross-sectional area of said first opening.

2. The ink-jet cartridge according to claim 1 wherein said back pressure of said interior of said housing is regulated by a capillary action of said ink contained in said pressure-adjusting device.

3. The ink-jet cartridge according to claim 1 wherein said second opening of said pressure-adjusting device is fixed at said bottom of said interior of said housing.

4. The ink-jet cartridge according to claim 1 wherein said second opening of said pressure-adjusting device is hung over said bottom of said interior of said housing.

5. The ink-jet cartridge according to claim 1 wherein each said regulating hole has a cross-sectional area ranging from 0.05 to 2.5 $mm^2$.

6. The ink-jet cartridge according to claim 1 wherein said uniform diameter of said hollow tube is in an approximate range from 0.5 to 2.0 mm.

7. The ink-jet cartridge according to claim 1 wherein said second opening has one regulating hole and said second opening is plane-shaped in cross-section.

8. The ink-jet cartridge according to claim 7 wherein said hollow tube is made of a material selected from a group consisting of stainless, plastic and rubber.

9. The ink-jet cartridge according to claim 1 wherein said hollow tube is made of a material selected from a group consisting of stainless, plastic and rubber.

10. The ink-jet cartridge according to claim 1 wherein said pressure-adjusting device is integrally formed with said housing by injection molding.

11. The ink-jet cartridge according to claim 10 wherein said pressure-adjusting device is made of a material selected from plastic and rubber.

* * * * *